US011225092B2

(12) United States Patent
Kaneko et al.

(10) Patent No.: US 11,225,092 B2
(45) Date of Patent: Jan. 18, 2022

(54) LIQUID EJECTION APPARATUS AND LIQUID EJECTION METHOD

(71) Applicants: Takaaki Kaneko, Kanagawa (JP); Kohsuke Inoue, Kanagawa (JP)

(72) Inventors: Takaaki Kaneko, Kanagawa (JP); Kohsuke Inoue, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/930,667

(22) Filed: Jul. 16, 2020

(65) Prior Publication Data

US 2021/0016580 A1 Jan. 21, 2021

(30) Foreign Application Priority Data

Jul. 18, 2019 (JP) ..... JP2019-133080
May 18, 2020 (JP) ..... JP2020-087046

(51) Int. Cl.
*B41J 11/00* (2006.01)
*B41J 2/045* (2006.01)

(52) U.S. Cl.
CPC ..... *B41J 11/0095* (2013.01); *B41J 11/008* (2013.01); *B41J 11/0035* (2013.01); *B41J 2/04556* (2013.01); *B41J 11/0025* (2013.01)

(58) Field of Classification Search
CPC ... B41J 11/0095; B41J 11/0035; B41J 11/008; B41J 2/04556; B41J 11/0025
See application file for complete search history.

(56) References Cited

U.S. PATENT DOCUMENTS 6,508,465 B1 * 1/2003 Endo ..... B65H 3/06 271/265.01
2011/0234730 A1 * 9/2011 Fukui ..... B41J 13/226 347/104
2016/0167410 A1 * 6/2016 Takada ..... B41J 13/0009 347/16
2019/0241385 A1 8/2019 Kaneko et al.

FOREIGN PATENT DOCUMENTS

JP 2001-041898 A 2/2001
JP 2003-255774 A 9/2003
JP 2015-009545 A 1/2015
JP 2017-217828 A 12/2017
JP 2018-130844 A 8/2018
(Continued)

*Primary Examiner* — Henok D Legesse
(74) *Attorney, Agent, or Firm* — Harness, Dickey & Pierce, P.L.C.

(57) ABSTRACT

A liquid ejection apparatus includes a first control unit, a light projection unit, a light reception unit, a determination unit, and a liquid ejection head. The first control unit is configured to change a threshold for determining a lifting of a recording medium conveyed along a conveyance path according to thickness of the recording medium. The light projection unit is configured to emit a detection beam for detecting the lifting of the recording medium. The light reception unit is configured to receive the detection beam. The determination unit is configured to determine the lifting of the recording medium, when the recording medium is detected with a height greater than the threshold by the detection beam. The liquid ejection head is configured to eject liquid to the recording medium.

11 Claims, 7 Drawing Sheets

(56) References Cited

FOREIGN PATENT DOCUMENTS

| | | | |
|---|---|---|---|
| JP | 2018-153939 | A | 10/2018 |
| JP | 2019-136910 | A | 8/2019 |
| JP | 2019-177675 | A | 10/2019 |
| JP | 2020-082456 | A | 6/2020 |
| JP | 2020-085745 | A | 6/2020 |

* cited by examiner

LIQUID EJECTION APPARATUS AND LIQUID EJECTION METHOD

CROSS-REFERENCE TO RELATED APPLICATIONS

The present application claims priority under 35 U.S.C. § 119 to Japanese Patent Application No. 2019-133080, filed on Jul. 18, 2019 and Japanese Patent Application No. 2020-087046, filed on May 18, 2020. The contents of which are incorporated herein by reference in their entirety.

BACKGROUND OF THE INVENTION

1. Field of the Invention

The present invention relates to a liquid ejection apparatus and a liquid ejection method.

2. Description of the Related Art

An inkjet type image forming apparatus has been known. A typical inkjet type image forming apparatus includes a head that ejects liquid droplets. A recording medium is conveyed under the head. The liquid droplets ejected from the head land on the medium, and as a result, an image is formed.

In recent years, the inkjet method is also applied to a commercial image forming apparatus. A high image quality is required for the commercial image forming apparatus using the inkjet method. Consequently, the distance between the inkjet head and the recording medium (for example, a sheet of paper) needs to be set close to about 1 mm. Thus, if the sheet is lifted even slightly, the sheet may come into contact with the head, and damage the head. In the present specification, a state in which the sheet comes into contact with the head is referred to as a head attack.

To prevent the head attack, it is important to detect the lifting of the sheet. Thus, a configuration in which a detection mechanism for detecting the lifting of the sheet is provided in the upstream of the inkjet head has been known. The detection mechanism is implemented by a pair of optical sensors including a light projection unit that projects laser light and a light reception unit that receives the laser light.

Hereinafter, in the present specification, the pair of optical sensors are referred to as a sheet lifting sensor. The light projection unit emits laser light in a direction orthogonal to the conveyance direction of the sheet, above the sheet, and in parallel with the sheet. When the laser light is emitted with the sheet being conveyed, the laser light is blocked if the sheet is lifted, whereby the intensity of the light received by the light reception unit varies. Whether the sheet is lifted is determined by the variation.

In general, the image forming apparatus forms images on different types of sheets. For example, the type of sheet may be thickness of the sheet. When a plurality of types of sheets with different thicknesses are used, the distance between the head and the sheet is varied. Thus, the laser light used for detecting the sheet lifting needs to be adjusted according to the thickness of the sheet.

For example, Japanese Unexamined Patent Application Publication No. 2015-009545 discloses a configuration in which the distance between the head and the sheet is made the same even when sheets with different thicknesses are conveyed, and a sheet lifting amount for determining the sheet lifting is fixed.

In other words, in this technology, glass is provided between the light projection unit and the light reception unit, and by controlling the rotation angle of the glass, the height of the emitted laser light is changed, and the sheet lifting is detected using the fixed lifting amount.

However, in the conventional technology, the rotation angle of the glass needs to be controlled accurately, and it has been difficult to correctly determine the lifting of a recording medium in real time, according to the thickness of the recording medium.

SUMMARY OF THE INVENTION

According to an aspect of the present invention, a liquid ejection apparatus includes a first control unit, a light projection unit, a light reception unit, a determination unit, and a liquid ejection head. The first control unit is configured to change a threshold for determining a lifting of a recording medium conveyed along a conveyance path according to thickness of the recording medium. The light projection unit is configured to emit a detection beam for detecting the lifting of the recording medium. The light reception unit is configured to receive the detection beam. The determination unit is configured to determine the lifting of the recording medium, when the recording medium is detected with a height greater than the threshold by the detection beam. The liquid ejection head is configured to eject liquid to the recording medium.

BRIEF DESCRIPTION OF THE DRAWINGS

The accompanying drawings are intended to depict exemplary embodiments of the present invention and should not be interpreted to limit the scope thereof. Identical or similar reference numerals designate identical or similar components throughout the various drawings.

DESCRIPTION OF THE EMBODIMENTS

Figure 1:
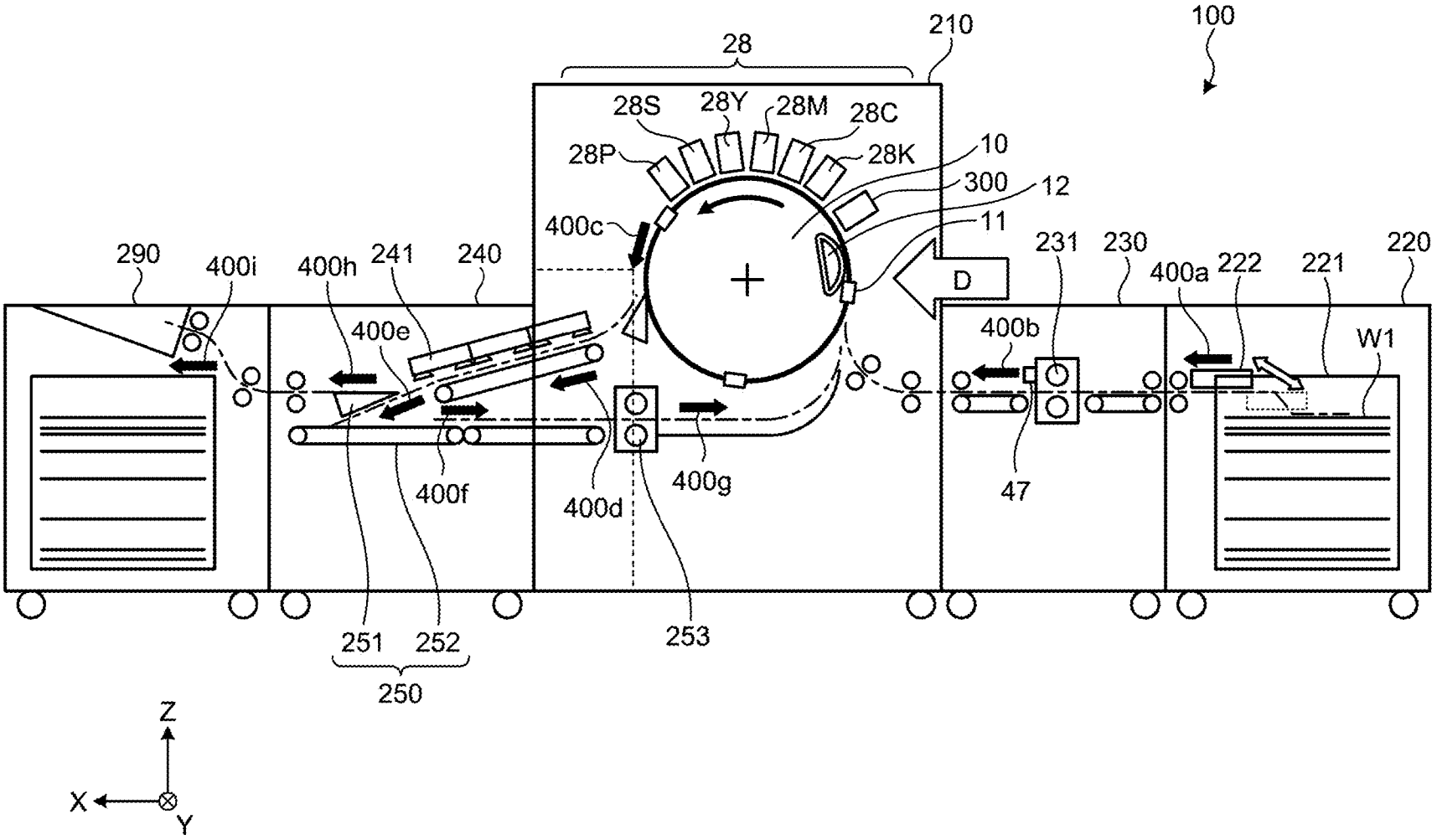
FIG. 1 is a diagram illustrating an example of a liquid ejection apparatus of an embodiment.

The terminology used herein is for the purpose of describing particular embodiments only and is not intended to be limiting of the present invention.

As used herein, the singular forms "a", "an" and "the" are intended to include the plural forms as well, unless the context clearly indicates otherwise.

In describing preferred embodiments illustrated in the drawings, specific terminology may be employed for the sake of clarity. However, the disclosure of this patent specification is not intended to be limited to the specific terminology so selected, and it is to be understood that each specific element includes all technical equivalents that have the same function, operate in a similar manner, and achieve a similar result.

Hereinafter, an embodiment of a liquid ejection apparatus and a liquid ejection method will be described in detail with reference to the accompanying drawings.

An embodiment has an object to provide a liquid ejection apparatus and a liquid ejection method capable of correctly determining the lifting of a recording medium in real time, according to the thickness of the recording medium.

FIG. 1 is a diagram illustrating an example of a liquid ejection apparatus 100 of the embodiment. The example in FIG. 1 illustrates when the liquid ejection apparatus 100 is an on-demand line scan-type inkjet recording apparatus. The liquid ejection apparatus 100 includes a liquid ejection unit 210, a sheet feeding unit 220, a registration adjusting unit 230, a drying unit 240, a recording medium reversing unit 250, and a sheet ejection unit 290. In the embodiment, the liquid ejection unit 210 is an image forming unit.

An example of a printing flow will now be described. First, each of recording media (for example, sheets of paper and the like) W1 stacked on a sheet feeding stack 221 of the sheet feeding unit 220 is picked up one by one by an air separation unit 222. The recording medium W1 is then conveyed in a direction of the liquid ejection unit 210. In FIG. 1, the conveyance direction of the recording medium W1 is illustrated by arrows 400*a* to 400*i*.

The air separation unit 222 is a mechanism for blowing air from the side surface toward the recording media W1 stacked on the sheet feeding stack. Due to the air blowing, air is blown between pieces of the stacked recording media W1, and a gap is formed between the pieces of the recording media W1. Thus, the pieces of the recording media W1 that are brought into contact with each other in a stacked manner are separated one by one, and can be easily picked up and fed.

When the recording medium W1 conveyed from the sheet feeding unit 220 reaches the registration adjusting unit 230, the registration adjusting unit 230 corrects the inclination of the recording medium W1. A pair of registration rollers 231 are disposed in the registration adjusting unit 230. The pair of registration rollers 231 correct the inclination of the recording medium W1.

When the registration is adjusted, the recording medium W1 is sent to the liquid ejection unit 210. A thickness detection unit 47 and a pair of optical sensors 300 are disposed in the upstream of a liquid ejection head module 28. The thickness detection unit 47 detects the thickness of the recording medium W1. The detected thickness of the recording medium W1 is used for determining the threshold of the pair of optical sensors 300.

The tip end of the recording medium W1 is nipped by a recording medium gripper 11 provided on the surface of a drum 10 formed in a cylindrical shape. In FIG. 1, the recording medium gripper 11 is provided on three locations of the drum. With the rotation of the drum 10, the recording medium W1 is rotated and conveyed to a position facing liquid ejection head modules 28K to 28P.

The liquid ejection head modules 28K to 28P eject ink by an inkjet method. The liquid ejection head modules 28K to 28P are arranged along the surface of the cylindrical drum 10 at an angle in the radial direction. Each of the liquid ejection head modules 28K to 28P is filled with a predetermined ink. The liquid ejection head modules 28K to 28P sequentially eject ink of black, cyan, magenta, and yellow (four basic colors of CMYK), as well as special colors (for example, gold, transparent, and the like).

In the liquid ejection unit 210, an image is formed on the recording medium W1, when the liquid ejection head modules 28K to 28P eject ink onto the outer periphery of the recording medium W1 that is held on the surface of the drum 10, from the outside of the circumference. Hereinafter, if there is no need to distinguish the liquid ejection head modules 28K to 28P, the liquid ejection head modules 28K to 28P are simply referred to as the liquid ejection head module 28.

An idle ejection receiver 12 is provided on the outer periphery of the cylindrical drum 10. When the liquid ejection head module 28 is not ejecting ink to the recording medium W1, the idle ejection receiver 12 receives the ink ejected as an idle ejection.

The recording medium W1 on which an image is formed is sent to the drying unit 240. A dryer unit 241 is disposed in the drying unit 240. Typically, the dryer unit 241 is a heater. When the recording medium W1 passes under the dryer unit 241, the moisture of the recording medium W1 is evaporated. The recording medium reversing unit 250 including a recording medium reversing mechanism 251 is also provided in the drying unit 240.

In the single-sided printing, the recording medium reversing mechanism 251 switches the conveyance path so that the recording medium W1 is sent to 209.

Alternatively, in the double-sided printing, the recording medium reversing mechanism 251 switches the conveyance path so that the recording medium W1 is sent to a reverse conveyance unit 252. The recording medium W1 is conveyed in the direction of the liquid ejection unit 210 again via the reverse conveyance unit 252. In this process, the recording medium W1 first reaches a registration roller 253. The registration roller 253 corrects the inclination of the recording medium W1. The recording medium W1 then reaches the drum 10. In this manner, an image is formed on the rear surface of the recording medium W1.

The recording medium W1 dried by the drying unit 240 is conveyed to the sheet ejection unit 290, and will be stacked in an aligned manner.

Figure 2:
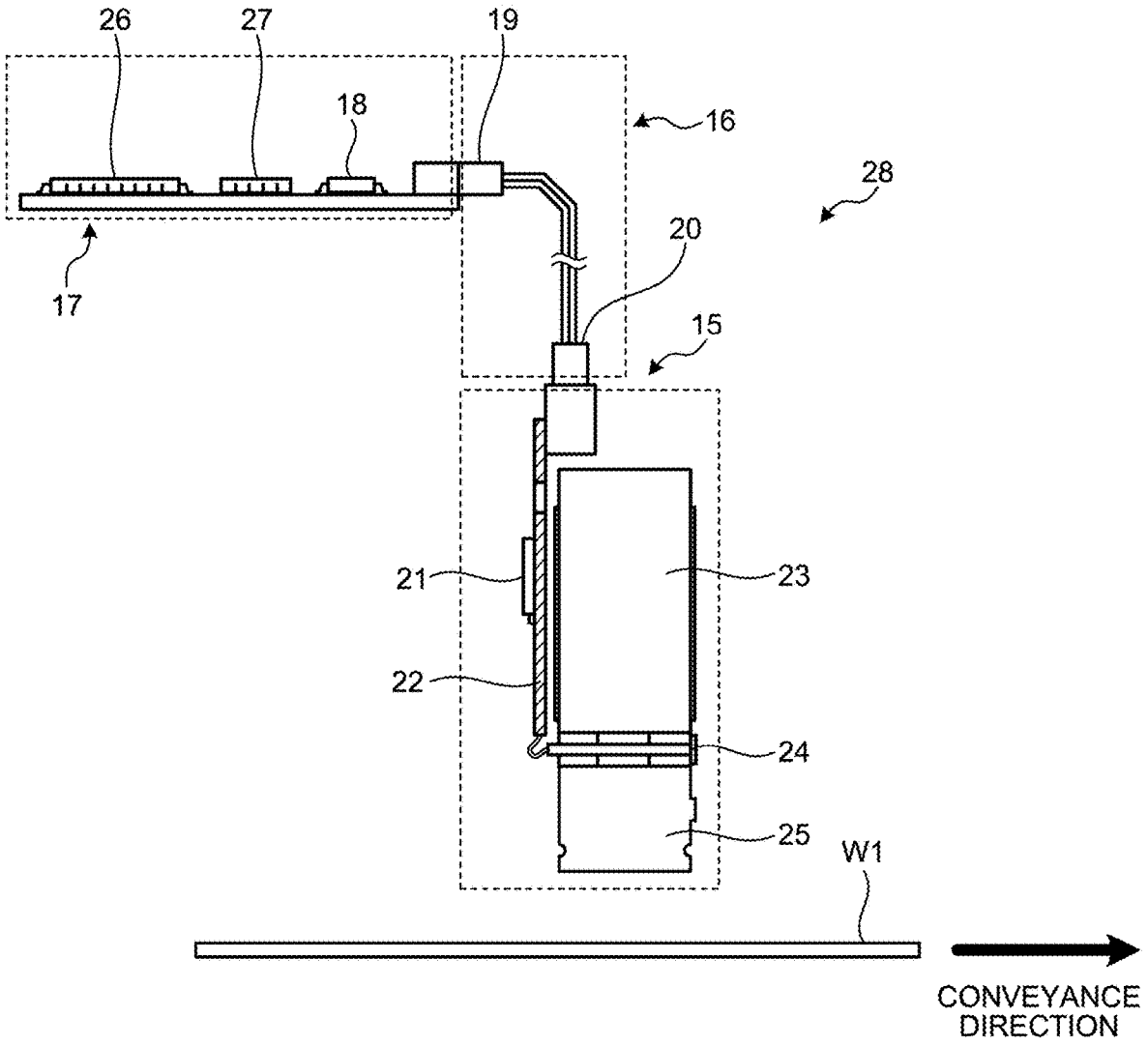
FIG. 2 is a diagram illustrating an example of a liquid ejection head module of the embodiment.

FIG. 2 is a diagram illustrating an example of the liquid ejection head module 28 of the embodiment. The liquid ejection head module 28 mainly includes a drive control substrate 17, a liquid ejection head 15, and a cable 16. The liquid ejection head 15 is an inkjet recording head in the embodiment. A drive control unit 26, a drive waveform generation unit 27, and a storage unit 18 are mounted on the drive control substrate 17. A drive control substrate connector 19 and a head side connector 20 are fitted to the cable 16. The cable 16 is used for communication between the drive control substrate 17 and a head substrate 22 mounted on the liquid ejection head 15, using analog signals and digital signals.

The liquid ejection head 15 mainly includes a residual vibration detection module 21, the head substrate 22, a head driving IC substrate 24, a head ink tank 23, and a rigid plate 25. The line scan-type inkjet recording apparatus has a line head structure in which a plurality of the liquid ejection heads 15 are arranged in the depth direction (or front direction) of the sheet surface that is a direction perpendicular to the conveyance direction of the recording medium W1. However, the structure of the liquid ejection apparatus 100 of the embodiment is not limited to the above-described line scan-type structure (for example, the structure that a serial scan type printer, the other liquid ejection apparatus, or the like has) that allows an image to be formed by moving one or a plurality of the liquid ejection heads 15 in the depth direction (or front direction) of the sheet surface that is the direction perpendicular to the conveyance direction of the recording medium W1 while conveying the recording medium W1 in the conveyance direction.

Figure 3A:
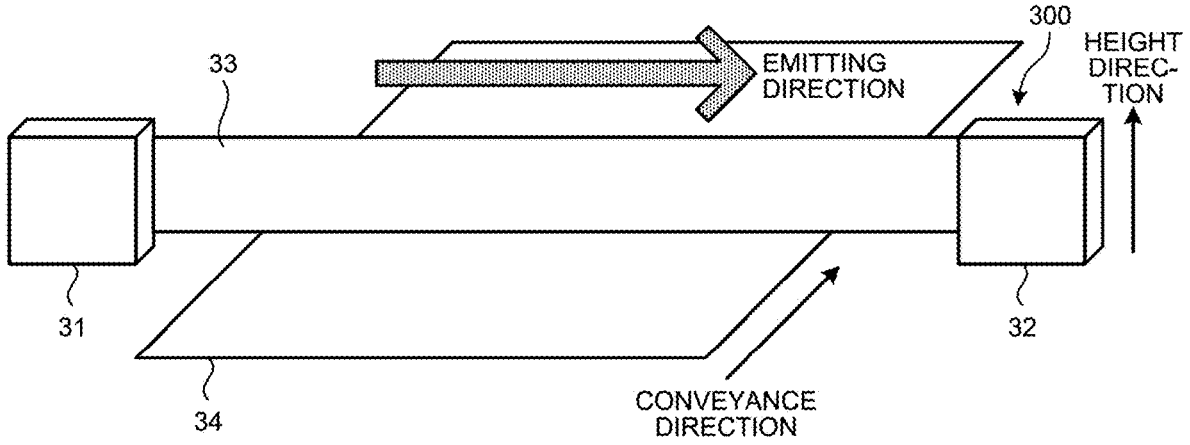
FIG. 3A is a diagram illustrating an example of a pair of optical sensors of the embodiment.
Figure 3B:
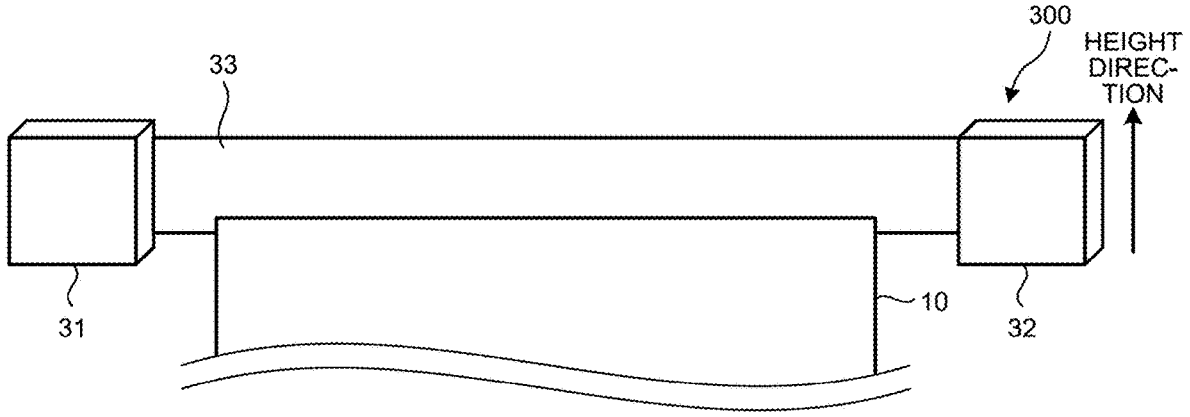
FIG. 3B is a sectional view illustrating a relation between a drum, the pair of optical sensors, and a detection beam.
Figure 3C:
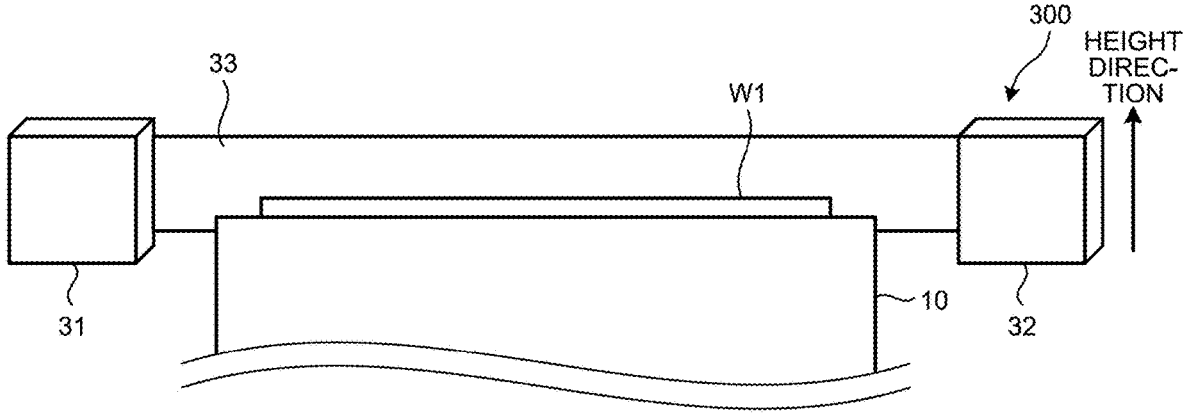
FIG. 3C is a sectional view illustrating a state in which a recording medium is conveyed.
Figure 3D:
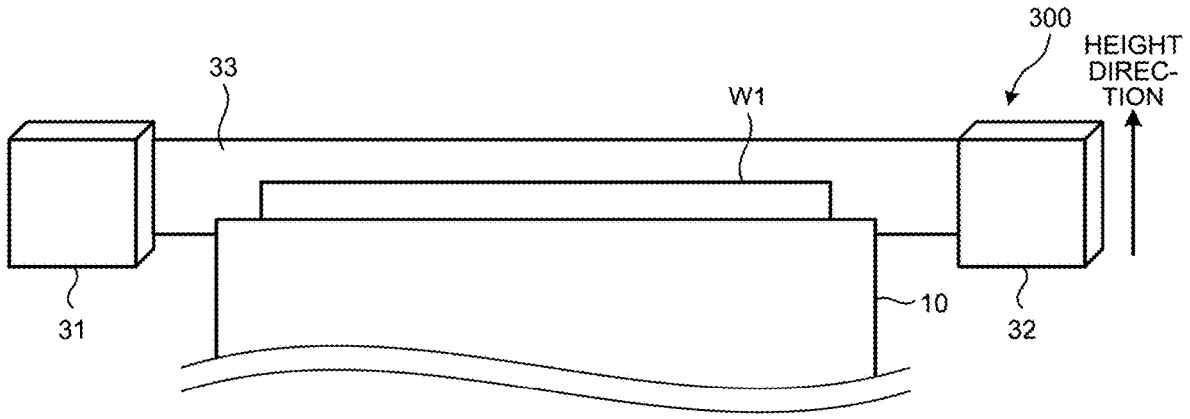
FIG. 3D is a sectional view illustrating a state in which a recording medium is conveyed.
Figure 3E:
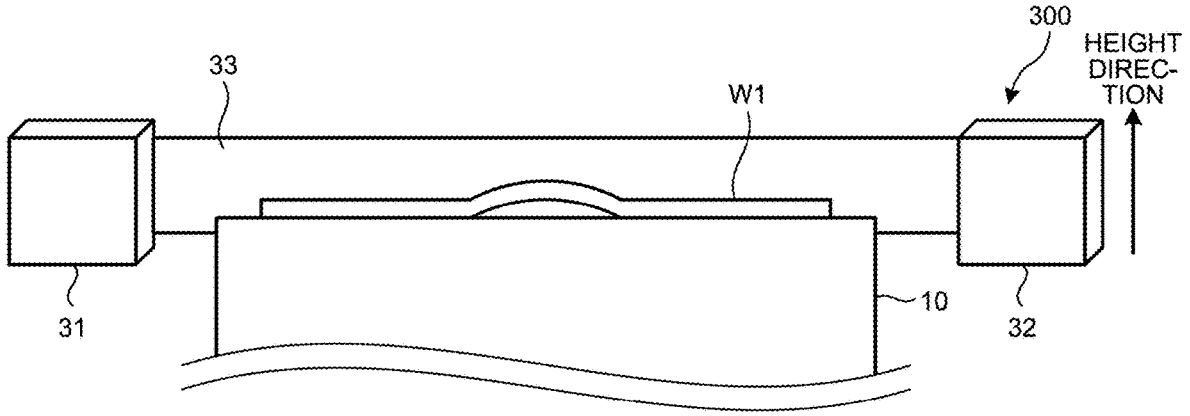
FIG. 3E is a sectional view illustrating a state in which the sheet is lifted.

FIG. 3A is a diagram illustrating an example of the pair of optical sensors 300 of the embodiment. The pair of optical sensors 300 include a light projection unit 31 and a light reception unit 32. FIG. 3A is a perspective view illustrating the pair of optical sensors 300. FIG. 3B is a sectional view illustrating a relation between the drum, the pair of optical sensors 300, and a detection beam. FIG. 3C and FIG. 3D are sectional views each illustrating a state in which the recording medium W1 is conveyed. FIG. 3E is a sectional view illustrating a state in which the sheet is lifted.

The pair of optical sensors 300 that include the light projection unit 31 and the light reception unit 32 are installed in the upstream of the liquid ejection head module 28 as described above. The light projection unit 31 and the light reception unit 32 are disposed outside of both side surfaces of the drum 10. For example, the light projection unit 31 and the light reception unit 32 are fixed to a frame (not illustrated) irrespective of the rotation of the drum 10.

A detection beam 33 emitted from the light projection unit 31 has a predetermined width in the height direction. The height direction is a direction perpendicular to the surface of the drum 10. A part of the detection beam 33 is blocked by the drum 10, and the remaining part reaches the light reception unit 32.

The light projection unit 31 is a light-emitting means of the optical sensor. For example, the light projection unit 31 emits the detection beam (laser light) 33 parallel to a conveyance surface 34. The light projection unit 31 emits the detection beam 33 substantially parallel with a slight angle. This is because the variation in detection may be reduced when mounting with the slight angle because of the characteristics of light (such as diffraction).

The light reception unit 32 is a light receiving means of the optical sensor. The light reception unit 32 receives the detection beam 33, and outputs a voltage value corresponding to the amount of the received light. The height of an object that is blocking the detection beam 33 can be measured from the voltage value.

As described above, a part of the detection beam 33 is blocked by the drum 10, and the remaining part reaches the light reception unit. In other words, even in a state in which a sheet is not conveyed, a part of the detection beam 33 is blocked by the drum 10, and the remaining part reaches the light reception unit. Moreover, when a sheet is conveyed, the detection beam 33 is blocked by the thickness of the sheet. Furthermore, when the sheet is lifted, the detection beam 33 is further blocked.

In such a configuration, it is possible to obtain the height of the drum surface first, in a state in which a sheet is not conveyed. The drum is formed in a cylindrical shape, and when the drum is rotated once, variation may occur due to the eccentricity of the drum shaft and a mechanical problem in the driving mechanism. Thus, the drum is rotated once in a state in which a sheet is not conveyed. By identifying the variation in the height of the drum caused by the rotation during one cycle, and by subtracting the variation of the drum from the variation detected when the sheet is conveyed, it is possible to calculate the variation only caused when the sheet is conveyed.

FIG. 3C and FIG. 3D are each a sectional view illustrating a state in which the sheet is conveyed.

FIG. 3C is a sectional view illustrating a state in which the recording medium W1 with a relatively thin thickness is conveyed. The detection beam 33 is further blocked as much as the recording medium W1 that is being conveyed on the drum. Consequently, the amount of light that reaches the light reception unit 32 is reduced than that in FIG. 3B.

FIG. 3D is a sectional view illustrating a state in which the recording medium W1 with a relatively thick thickness is conveyed. The thickness of the recording medium W1 is thicker than that in FIG. 3C. Consequently, the amount of the detection beam 33 is further blocked. As a result, the amount of light that reaches the light reception unit 32 is reduced than that in FIG. 3C.

FIG. 3E is a sectional view illustrating a state in which the sheet is lifted. When the sheet is lifted, the sheet reaches to a higher position. FIG. 3E illustrates a state in which a part of the sheet is curved. The sheet lifting also occurs when the whole sheet is separated from the drum.

The light reception unit 32 detects the shielding amount of the linear detection beam 33 output from the light projection unit 31 in the height direction. The linear detection beam 33 is the detection beam 33 having a width in the height direction. The amount of the detection beam 33 that has reached the light reception unit 32 without being blocked by the drum 10 and the sheet is detected by the light reception unit 32 with each height.

In this manner, depending on the thickness of the sheet and a lifting degree of the sheet, the amount of light that reaches the light reception unit varies. By detecting the amount of the received light, it is possible to identify the conveyance state of the sheet.

As described above, first the height of the drum surface is detected by projecting a beam with a sheet not being conveyed. The sheet is then actually conveyed, and the light reception unit receives the beam blocked by the sheet and the sheet lifting. By comparing the amounts of the received light, it is possible to obtain how much the beam received by the light reception unit is reduced as a result of conveying the sheet.

The reduction amount of the beam is the total of an amount due to blocking by the sheet being conveyed and an amount due to blocking by the lifted sheet when the sheet is lifted.

An image forming apparatus recognizes the type of sheet that is currently being conveyed. Consequently, the image forming apparatus can obtain how much the sheet is lifted by subtracting the reduction amount of the beam caused by the sheet being conveyed, from the reduction amount of the beam that is actually received by the light reception unit.

In this manner, the light reception unit 32 detects the presence and amount of the lift of the sheet according to the amount of the detection beam 33 that is blocked when the recording medium W1 conveyed on the conveyance surface 34 along the conveyance path is lifted.

In FIG. 3A to FIG. 3E, the light projection unit 31 and the light reception unit 32 are mounted so as to face each other. However, the light projection unit 31 and the light reception unit 32 may not necessarily face each other. For example, the light projection unit 31 and the light reception unit 32 may be formed into a single module and placed on the same location. In this case, for example, with a member such as a reflection plate being placed at the facing position, the recording medium W1 is separated so as to form a path of the detection beam 33.

Figure 4:
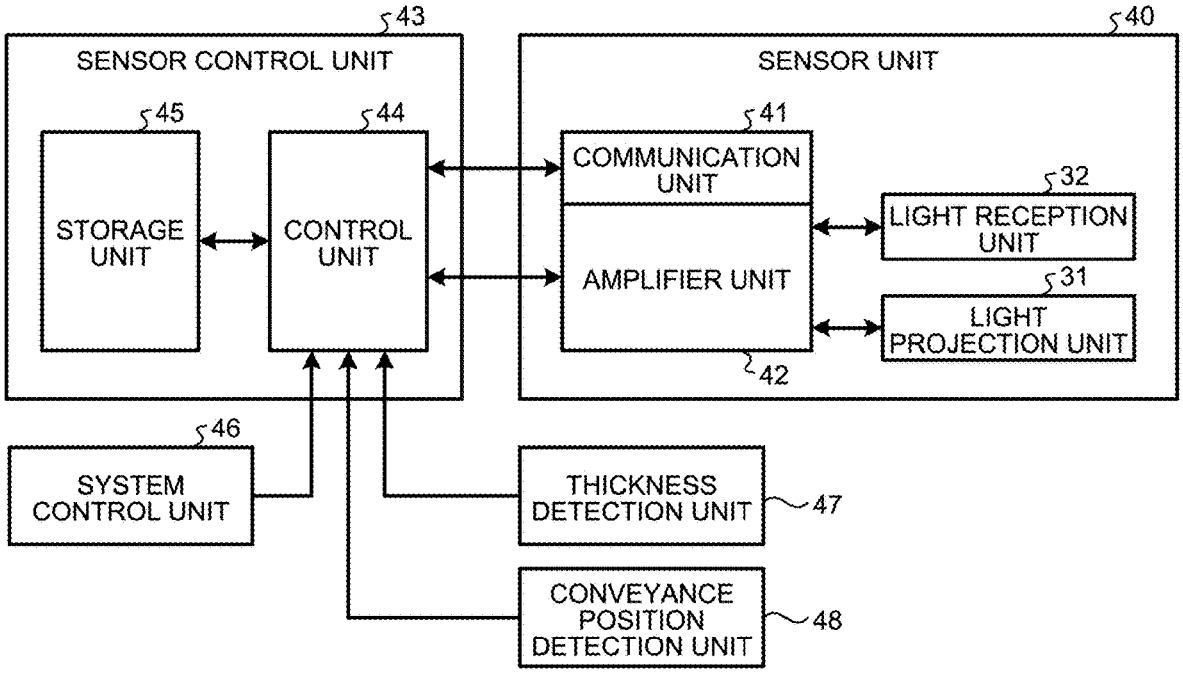
FIG. 4 is a diagram illustrating an example of a functional configuration of the main part of the liquid ejection apparatus of the embodiment.

FIG. 4 is a diagram illustrating an example of a functional configuration of the main part of the liquid ejection apparatus 100 of the embodiment. A sensor control unit 43 includes a control unit 44 and a storage unit 45. For example, the sensor control unit 43 is implemented by a sub-central processing unit (CPU) (first control unit). For example, a system control unit 46 is implemented by a main CPU (second control unit).

A sensor unit 40 is a function block including the light projection unit 31 and the light reception unit 32 described above. The sensor unit 40 further includes a communication unit 41 and an amplifier unit 42 (determination unit). For example, the communication unit 41 includes an interface (IF) such as RS232C, and receives a threshold from the control unit 44 (first control unit). The amplifier unit 42 (determination unit) determines the presence and amount of the lift of the sheet according to the detected result of the light reception unit. In other words, when the lifted recording medium W1 reaches the height of a threshold (detection threshold) of the detection beam 33, the occurrence of abnormality is notified to the system control unit 46. When abnormality is notified, the system control unit 46 stops the conveyance operation of the recording medium W1.

The storage unit 45 is a storage device that holds information in the sensor control unit 43. For example, the storage unit 45 stores therein the thickness of the recording medium W1. The control unit 44 determines the threshold on the basis of the thickness of the recording medium. For example, a method of acquiring the thickness of the recording medium W1 performed by the control unit 44 includes the following two methods.

For example, the first method is a method in which the thickness detection unit 47 (for example, a filler, a range sensor, and the like) for detecting the thickness of the recording medium W1 is disposed on the upstream side in the conveyance direction as illustrated in FIG. 1. The thickness detection unit 47 inputs the detected result including the detected thickness to the control unit 44. The control unit 44 calculates the threshold on the basis of the detected thickness, and transmits the threshold to the sensor unit 40. For example, the control unit 44 increases the threshold with an increase in the detected thickness. In the first method, because the thickness detection unit 47 actually observes the recording medium W1, it is possible to eliminate the thickness error. Moreover, the first method can even deal with a situation such as when the information on the recording medium W1 included in a print job is different from that of the recording medium W1 actually conveyed.

The second method is a method in which recording medium information including the thickness of the recording medium W1 is transmitted to the control unit 44 from the system control unit 46 (second control unit). The control unit 44 refers to correspondence information indicating a correspondence relation between the recording medium information and the threshold stored in the storage unit 45, and transmits the threshold determined from the correspondence relation to the sensor unit 40. In the second method, it is possible to change the threshold on the basis of the recording medium information included in the main CPU. Consequently, the thickness detection unit 47 installed in the front stage of the pair of optical sensors 300 becomes unnecessary.

Moreover, the threshold is updated by the control unit 44. For example, a method for determining the timing to change the threshold includes the following two methods.

The first method is a method in which a conveyance position detection unit 48 (for example, a general-purpose photosensor and the like) for detecting the conveyance position of the recording medium W1 is disposed on the upstream side in the conveyance direction. When the recording medium W1 is detected at the conveyance position before the position where the liquid is ejected by the liquid ejection head 15 (for example, immediately before the position where the liquid is ejected), the control unit 44 changes the threshold. For example, the conveyance position before the position where the liquid is ejected is a conveyance position at which the distance from the position where the liquid is ejected by the liquid ejection head 15 is smaller than a distance threshold.

The second method is a method in which a change notification is transmitted to the control unit 44 at the timing when the recording medium W1 reaches the position where the ink is ejected by the liquid ejection head 15. For example, this timing is defined by a predetermined time that has passed from the conveyance start timing of the recording medium W1. The system control unit 46 measures the time that has passed from the conveyance start timing of the recording medium W1, and when a predetermined time has passed from the conveyance start timing, transmits a change notification to the control unit 44. The control unit 44 changes the threshold upon receiving the change notification from the system control unit 46. Consequently, even when the recording media W1 of different thickness are continuously conveyed, it is possible to change the threshold at a suitable timing.

Figure 5A:
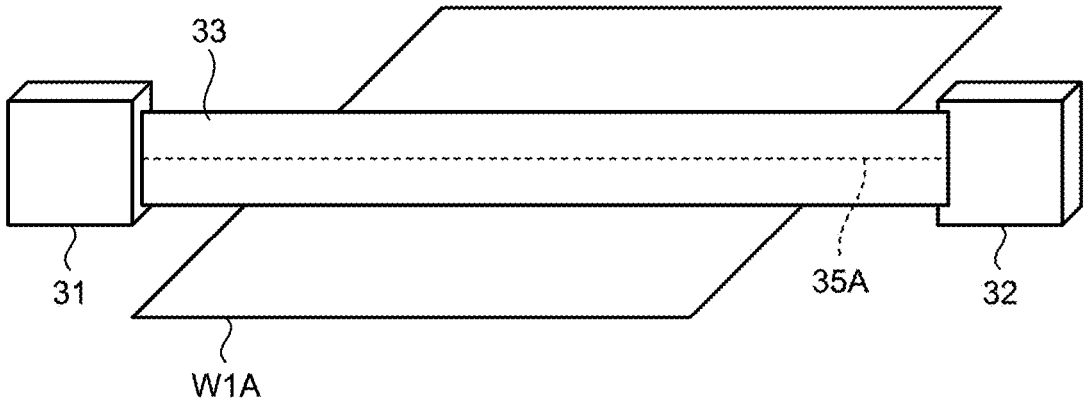
FIG. 5A is a diagram illustrating a first example of a threshold of the embodiment.
Figure 5B:
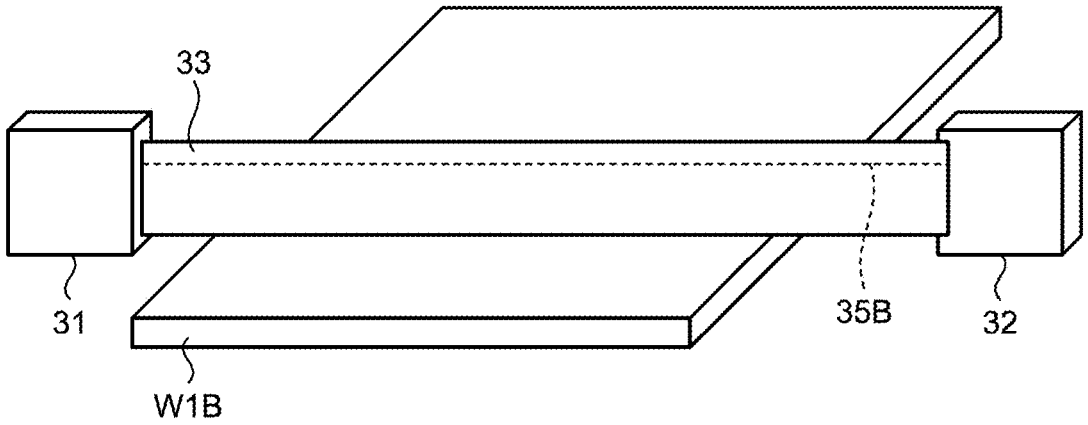
FIG. 5B is a diagram illustrating a second example of the threshold of the embodiment.

FIG. 5A is a diagram illustrating a first example of a threshold (threshold 35A) of the embodiment. The threshold 35A is determined on the basis of the thickness of a recording medium W1A. FIG. 5B is a diagram illustrating a second example of a threshold (threshold 35B) of the embodiment. The threshold 35A is determined on the basis of the thickness of a recording medium W1B. Hereinafter, if there is no need to distinguish between the recording media W1A and W1B, the recording media W1A and W1B are simply referred to as the recording medium W1. Similarly, if there is no need to distinguish between the threshold 35A and the threshold 35B, the threshold 35A and the threshold 35B are simply referred to as a threshold 35.

According to the thickness of the recording medium W1, for example, the control unit 44 updates the threshold 35 from the threshold 35A to the threshold 35B. Consequently, even when the recording media W1 with different thickness are conveyed, it is possible to change the threshold 35 in real time (according to the recording medium W1 to be conveyed), and fix the distance from the recording medium W1 to the lower part of the head array according to the threshold 35. In other words, it is possible to detect the lifting with the same lifting amount. For example, the control unit 44 increases the threshold 35 with an increase in the thickness of the recording medium W1, and reduces the threshold 35 with a reduction in the thickness of the recording medium W1.

It is also possible to move the sensor unit (the light projection unit 31 and the light reception unit 32 in FIG. 5A and FIG. 5B) in the vertical direction to detect the lifting with the same lifting amount. However, in this case, such disadvantages occur that it takes a long time to move the unit, and an increase in cost by adding a mechanism for moving the unit.

Figure 6:
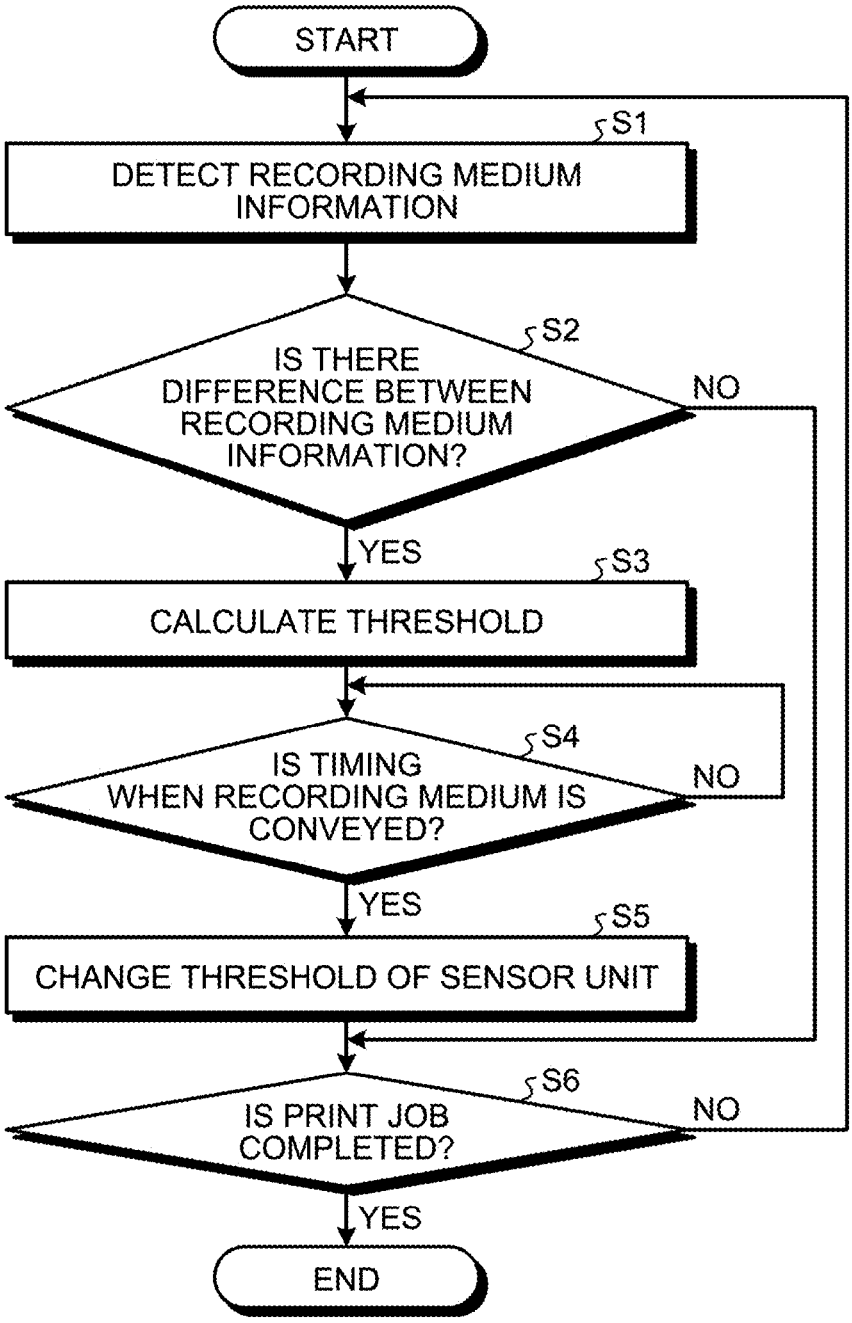
FIG. 6 is a flowchart illustrating an example of a liquid ejection method of the embodiment.

FIG. 6 is a flowchart illustrating an example of a liquid ejection method of the embodiment. First, the thickness detection unit 47 detects the recording medium information including the thickness of the recording medium W1 (step S1). Next, the control unit 44 determines whether there is a difference between the recording medium information detected this time and the recording medium information detected the previous time (step S2). If there is no difference (No at step S2), the process proceeds to step S6.

If there is a difference (Yes at step S2), the control unit 44 calculates the threshold 35 according to the recording medium information detected by the process at step S1, and stores therein the threshold 35 in the storage unit 45 (step S3). Next, the conveyance position detection unit 48 determines the timing when the recording medium W1 to be printed is conveyed to the sensor unit 40 (step S4). Next, immediately before the recording medium W1 is conveyed to the sensor unit 40 (Yes at step S4), the control unit 44 transmits the threshold 35 calculated by the process at step S3 to the sensor unit 40, and changes the threshold 35 of the sensor unit 40 (step S5).

Next, the control unit 44 determines whether the print job is completed (step S6). When the print job is not completed (No at step S6), the same process is performed on the next recording medium W1, and the process returns to step S1. When the print job is completed (Yes at step S6), the process is completed.

As described above, in the liquid ejection apparatus 100 of the embodiment, the control unit 44 (first control unit) changes the threshold 35 to determine the lifting of the recording medium W1 according to the thickness of the recording medium W1 conveyed along the conveyance path. After the threshold is changed, the light projection unit 31 emits the detection beam 33. As a result, the presence and amount of the lift of the sheet are detected by the configuration and operation as described above. When the amount of the lift of the sheet is greater than the threshold 35, it is determined that the recording medium 1 is lifted abnormally. Thus, the conveyance operation of the recording medium W1 will be stopped. When the recording medium W1 is not lifted, or when the lift of the recording medium W1 is smaller than the threshold, the recording medium W1 is continuously conveyed, and the liquid is ejected from the liquid ejection head module 28.

Consequently, with the liquid ejection apparatus 100 of the embodiment, it is possible to correctly determine the lifting of the recording medium W1 in real time according to the thickness of the recording medium W1. For example, even when the thickness of the sheet to be conveyed is changed in an environment where sheets are conveyed at high speed, it is possible to determine the lifting of the sheet with a fixed lifting amount in real time and at high accuracy.

With an embodiment, it is possible to effectively and correctly change the detection height according to the thickness of the sheet.

The above-described embodiments are illustrative and do not limit the present invention. Thus, numerous additional modifications and variations are possible in light of the above teachings. For example, at least one element of different illustrative and exemplary embodiments herein may be combined with each other or substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

The method steps, processes, or operations described herein are not to be construed as necessarily requiring their performance in the particular order discussed or illustrated, unless specifically identified as an order of performance or clearly identified through the context. It is also to be understood that additional or alternative steps may be employed.

Further, any of the above-described apparatus, devices or units can be implemented as a hardware apparatus, such as a special-purpose circuit or device, or as a hardware/software combination, such as a processor executing a software program.

Further, as described above, any one of the above-described and other methods of the present invention may be embodied in the form of a computer program stored in any kind of storage medium. Examples of storage mediums include, but are not limited to, flexible disk, hard disk, optical discs, magneto-optical discs, magnetic tapes, non-volatile memory, semiconductor memory, read-only-memory (ROM), etc.

Alternatively, any one of the above-described and other methods of the present invention may be implemented by an application specific integrated circuit (ASIC), a digital signal processor (DSP) or a field programmable gate array (FPGA), prepared by interconnecting an appropriate network of conventional component circuits or by a combination thereof with one or more conventional general purpose microprocessors or signal processors programmed accordingly.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA) and conventional circuit components arranged to perform the recited functions.

What is claimed is:

1. A liquid ejection apparatus comprising:

a light projection unit configured to emit a detection beam for detecting a lifting of a recording medium conveyed along a conveyance path;

a light reception unit configured to receive the detection beam;

a liquid ejection head configured to eject liquid to the recording medium; and at least one controller configured to, detect the lifting of the recording medium conveyed along the conveyance path in response to the recording medium being detected at a height greater than a threshold by the detection beam, and change the threshold in real time by detecting a thickness of the recording medium as the recording medium is being conveyed, and changing the threshold at a timing when the recording medium is detected at a conveyance position upstream of a position where the liquid is ejected by the liquid ejection head.

2. The liquid ejection apparatus according to claim 1, wherein the detection beam is a linear laser having a width in a height direction.

3. The liquid ejection apparatus according to claim 1, wherein the at least one controller is configured to receive recording medium information including the thickness of the recording medium, and refer to correspondence information indicating a correspondence relation between the recording medium information and the threshold to change the threshold.

4. The liquid ejection apparatus according to claim 1, further comprising:

a thickness detection unit configured to detect the thickness of the recording medium, wherein the at least one controller is configured to increase the threshold with an increase in the detected thickness.

5. The liquid ejection apparatus according to claim 1, further comprising:

a conveyance position detection unit configured to detect the conveyance position of the recording medium.

6. The liquid ejection apparatus according to claim 1, wherein the at least one controller is configured to, measure time from a conveyance start timing of the recording medium, and determine the timing to change the threshold based on the conveyance start timing.

7. The liquid ejection apparatus according to claim 1, wherein the at least one controller is configured to stop a conveyance operation of the recording medium when the recording medium is detected with the height greater than the threshold by the detection beam.

8. A liquid ejection method comprising:

emitting a detection beam for detecting a lifting of a recording medium conveyed along a conveyance path;

receiving the detection beam;

detecting the lifting of the recording medium conveyed along the conveyance path in response to the recording medium being detected at a height greater than a threshold by the detection beam;

changing the threshold in real time by detecting a thickness of the recording medium as the recording medium is being conveyed, and changing the threshold at a timing when the recording medium is detected at a conveyance position upstream of a position where liquid is ejected; and ejecting the liquid to the recording medium.

9. The liquid ejection apparatus according to claim 1, further comprising:

a registration adjusting unit including, a pair of registration rollers configured to correct an inclination in the recording medium and a thickness detection unit downstream of the pair of registration rollers and upstream of the liquid ejection head, the thickness detection unit configured to detect the thickness of the recording medium.

10. The liquid ejection apparatus according to claim 9, further comprising:

a conveyance position detection unit upstream of the liquid ejection head, the conveyance position detection unit configured to detect the conveyance position of the recording medium.

11. The liquid ejection apparatus according to claim 10, wherein the conveyance position detection unit is immediately adjacent to and upstream of the liquid ejection head.

* * * * *